US005473984A

United States Patent [19]

Terrell, Jr. et al.

[11] Patent Number: 5,473,984

[45] Date of Patent: Dec. 12, 1995

[54] DYNAMICALLY ADJUSTABLE PRINTHEAD ASSEMBLY

[75] Inventors: Jack L. Terrell, Jr., Kingston; Nick LaMoureaux, Everett, both of Wash.

[73] Assignee: Intermec Corporation, Everett, Wash.

[21] Appl. No.: 419,482

[22] Filed: Apr. 10, 1995

[51] Int. Cl.[6] ..... A41J 2/01

[52] U.S. Cl. ..... 101/485; 400/175; 400/120.17; 400/59

[58] Field of Search ..... 400/120.17, 55, 400/56, 59, 356, 174, 175; 101/485

[56] References Cited

U.S. PATENT DOCUMENTS

| | | | |
|---|---|---|---|
| 3,444,978 | 5/1969 | Teichmann et al. | 400/59 |
| 4,614,949 | 9/1986 | Hakkaku et al. | 400/356 |
| 4,720,200 | 1/1988 | Gomoll et al. | 400/59 |
| 4,738,552 | 4/1988 | Kikuchi et al. | 400/59 |
| 4,872,026 | 10/1989 | Rasmussen et al. | 400/175 |
| 5,064,303 | 11/1991 | Ricciardi | 400/175 |
| 5,074,686 | 12/1991 | Faré | 400/59 |
| 5,092,693 | 3/1992 | Uchimura | 400/175 |
| 5,156,466 | 10/1992 | Inagaki et al. | 400/59 |
| 5,157,415 | 10/1992 | Seyasu | 400/120.17 |
| 5,241,325 | 8/1993 | Nguyen | 400/175 |

*Primary Examiner*—Eugene H. Eickholt

*Attorney, Agent, or Firm*—M. Michael Carpenter; L. David Rish; Donald A. Streck

[57] ABSTRACT

An adjustable printhead-carrying yoke for a printer which permits dynamic adjusting of the printhead's fore and aft and skew positions. There is a fixed yoke portion carried by the printer and a movable yoke portion carrying the printhead. There is also fore and aft adjusting apparatus for moving the movable yoke portion thereby adjusting the printhead's fore and aft position while the printhead is printing and skew adjusting apparatus for moving the movable yoke portion thereby adjusting the printhead's skew while the printhead is printing.

19 Claims, 4 Drawing Sheets

DYNAMICALLY ADJUSTABLE PRINTHEAD ASSEMBLY

BACKGROUND OF THE INVENTION

This invention relates to printers having a positionally adjustable printhead and, more particularly, to an adjustable printhead-carrying yoke for a printer which permits dynamic adjusting of the printhead's fore and aft and skew positions comprising, a fixed yoke portion carried by the printer; a movable yoke portion carrying the printhead; fore and aft adjusting means for moving the movable yoke portion thereby adjusting the printhead's fore and aft position while the printhead is printing; and, skew adjusting means for moving the movable yoke portion thereby adjusting the printhead's skew while the printhead is printing.

Many printers for printing on a media employ a printhead positioned over a supporting platen plate or platen roller. Depending on the size of the printer and the mode of printing (e.g., impact, thermal activation, thermal transfer), the alignment of the printhead over the platen can be quite critical. Particularly in small label printers employing a thermal transfer printing process such as those manufactured by the assignee of this application, a small change in printhead alignment can make the difference between acceptable and unacceptable print quality.

Printhead alignment is typically a manufacturing and assembly process that remains constant once it is achieved barring some outside force that misaligns the printhead. Since it is critical, it is not something that the manufacture wants the end user to re-adjust. If re-adjustment is required, it is best accomplished by a trained repair person. Also, since it is critical, if the adjustment process is not quick, easy, and repeatable, it can add significantly to manufacturing time and cost as well as cause a bottleneck in the throughput of the manufacturing process.

In the prior art, printhead alignment is a static process. The adjustment process is depicted in FIG. 1 and 2. The printhead 10 is carried by a shaft 12 mounted to the bottom piece 14 of a yoke assembly 16. The top piece 18 of the yoke assembly 16 is mounted on a shaft 20 for lateral adjustment. Lateral adjustment is not a problem, so that will not be addressed further. The top piece 18 and the bottom piece 14 are joined by a pair of machine screws 22 passing through oversized bores 24 in the top piece 18 and threaded into the bottom piece 14. The top piece 18 is held in place by the shaft 20. Thus, with the machine screws 22 loosened, the bottom piece 14 can be moved forward and backward and skewed is depicted in FIG. 2 within the limits of the clearance fit of the machine screws 22 within the bores 24.

To adjust the printhead 10 using the yoke assembly 16, an adjusting fixture (not shown) is attached to the printhead 10 and the machine screws 22 are loosened. The fixture is then positioned on the platen (not shown). The machine screws 22 are then tightened and the fixture removed. The printer is then reassembled and tested for print quality. If not acceptable, the process is repeated. The same thing is true if a repair person has to re-align the printhead 10 in the field.

As can be appreciated, since the static alignment process is not exact and not repeatable, sometimes it provides acceptable print quality the first time it is done and sometimes it doesn't. And, there is no comparison since it is a static process. That is, the adjuster can not compare one position of alignment to another to determine the best position for the particular printer. This is a result of so-called "tolerance build-up". As is common in all manufacturing processes, each part in a printer is built to tolerance. If it is to be an inch long, that means that it can be an inch plus or minus the tolerance allowed. In general, tolerances average out and are not critical. In the area of printhead alignment, however, they are critical and if a particular printer as assembled has all its tolerances on one side (i.e. all plus or all minus), the build-up of the sizing errors can produce a problem for printhead alignment using the fixture, which is designed for a low tolerance or ideal printer.

Wherefore, it is an object of the present invention to provide a method and apparatus for dynamically adjusting printheads in printers.

It is another object of the present invention to provide a method and apparatus for adjusting printheads in printers which is not subject to tolerance build-up problems.

It is still another object of the present invention to provide a method and apparatus for adjusting printheads in printers which allows the adjuster to compare the print quality of different positional alignments.

Other objects and benefits of this invention will become apparent from the description which follows hereinafter when read in conjunction with the drawing Figures which accompany it.

SUMMARY

The foregoing objects have been attained in a printhead-carrying adjustable yoke for a printer having a fixed portion and a movable portion carrying the printhead by the apparatus for dynamically adjusting the printhead's position of the present invention comprising, fore and aft adjusting means for adjusting the printhead's fore and aft position while the printhead is printing; and, skew adjusting means for adjusting the printhead's skew while the printhead is printing.

In the preferred embodiment, the fore and aft adjusting means and the skew adjusting means comprise, first adjusting means for moving a first side of the movable portion of the yoke forward and backward; and, second adjusting means for moving a second side of the movable portion of the yoke opposite the first side forward and backward.

Preferably, the first adjusting means comprises a first eccentric carried by the movable portion of the yoke and pressing against surfaces of the fixed portion of the yoke to impart moving forces thereto; and, the second adjusting means comprises a second eccentric carried by the movable portion of the yoke and pressing against surfaces of the fixed portion of the yoke to impart moving forces thereto.

More preferably, the first adjusting means comprises a first tool having a cylindrical body with a radially offset pin extending longitudinally from an end thereof; and, the second adjusting means comprises a second tool having a cylindrical body with a radially offset pin extending longitudinally from an end thereof.

In the exemplary embodiment, he movable portion of the yoke has a first pin-receiving bore and a second pin-receiving bore therein; the fixed portion of the yoke has a slot therethrough with semi-cylindrical ends; the cylindrical body of the first tool is positioned in a semi-cylindrical end with the pin thereof disposed in the first pin-receiving bore; and, the cylindrical body of the second tool is positioned in a semi-cylindrical end with the pin thereof disposed in the second pin receiving bore.

In a first embodiment, the first tool and the second tool are removably carried by the yoke.

In a second embodiment, the first tool and the second tool have angled outer ends for gripping and turning.

In a third embodiment, the first tool and the second tool are non-removably carried by the yoke.

In a fourth embodiment, the first tool and the second tool have knurled outer ends for gripping and turning.

DESCRIPTION OF THE PREFERRED EMBODIMENT

Figure 1:
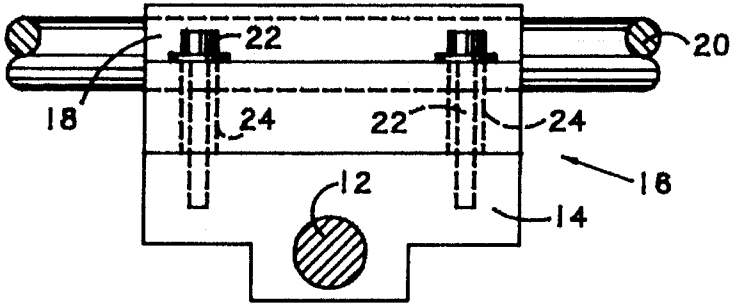
PRIOR ART FIG. 1
FIG. 1 is a front view of a prior art statically-adjustable printhead-carrying yoke.
Figure 2:
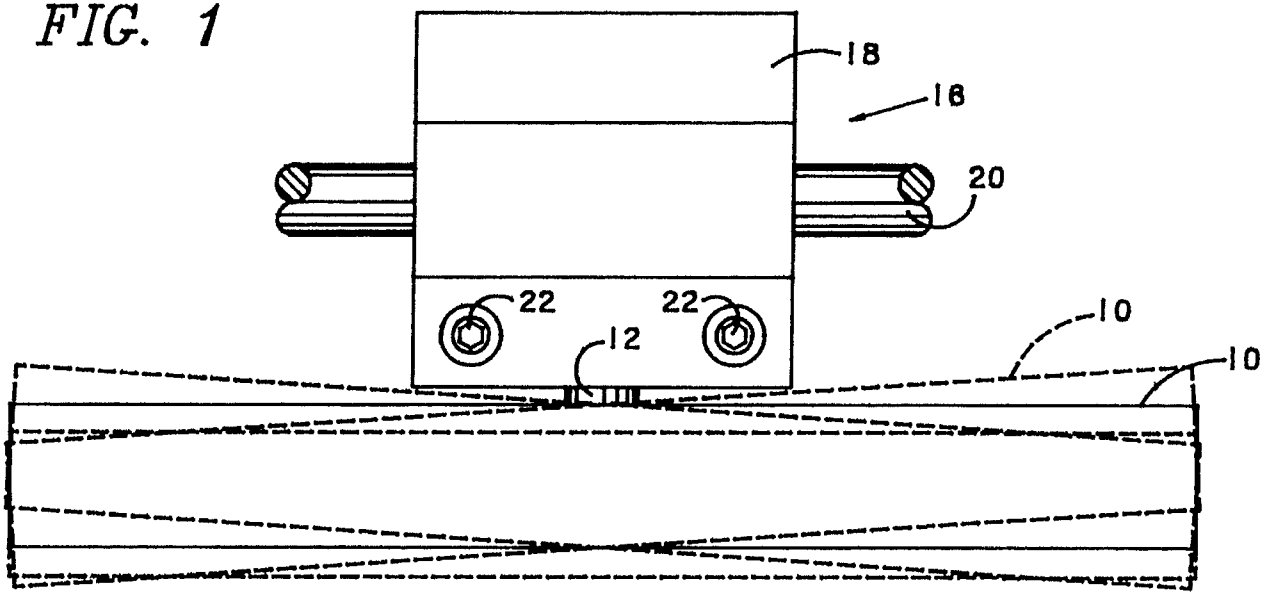
PRIOR ART FIG. 2
FIG. 2 is a plan view of the yoke of FIG. 1 depicting the adjustments accomplishable therewith.

The present invention comprises the yoke assembly 16 of the prior art modified by providing a slot 26 having semi-cylindrical ends 28 in the top piece 18 between the bores 24 and a pair of pin-receiving bores 30 in the bottom piece 14 under respective ends of the slot 26. Obviously, the single slot 26 could be replaced by a pair of shorter slots to accomplish the same functional results.

Figures 3, 4, 5, 6:
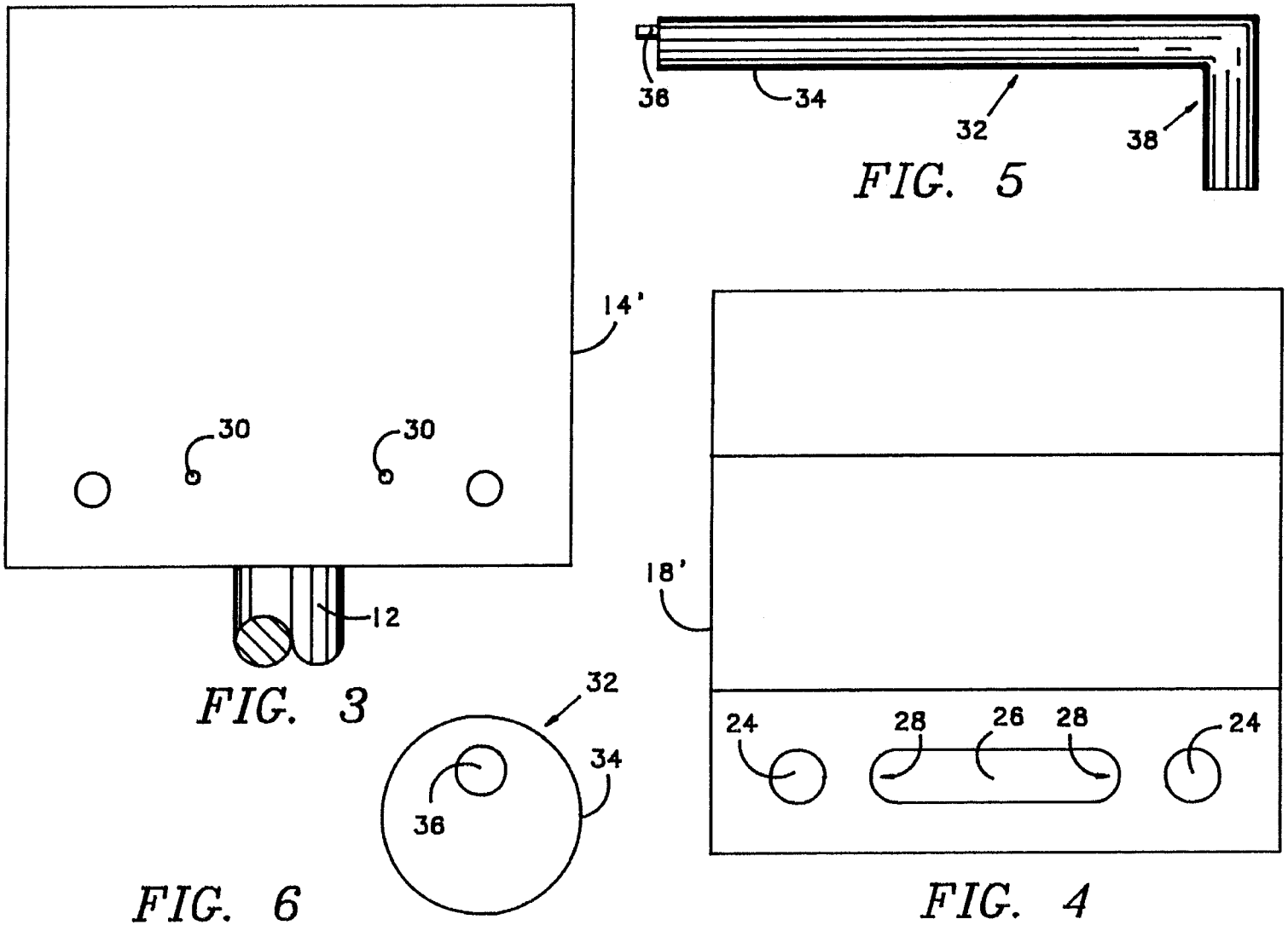
FIG. 3 is a plan view of the bottom piece of a dynamically-adjustable printhead-carrying yoke according to the present invention.
FIG. 4 is a plan view of the top piece of a dynamically-adjustable printhead-carrying yoke according to the present invention.
FIG. 5 is a side view of an adjusting tool used with the present invention.
FIG. 6 is a greatly enlarged end view of the adjusting end of the tool of FIG. 5.
Figure 11:
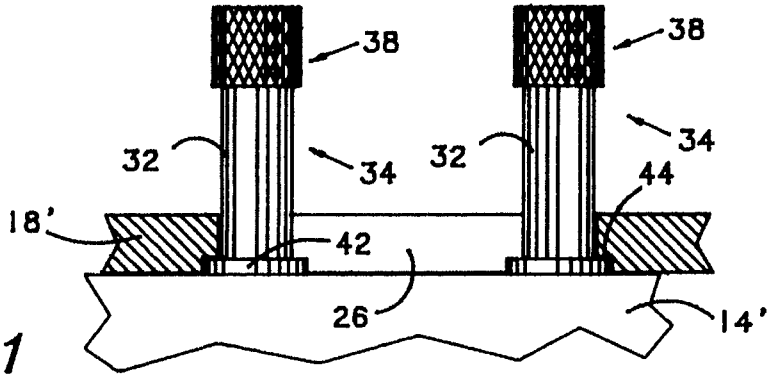
FIG. 11 is a partially cutaway view of the adjusting slot of the yoke of the present invention with a second embodiment of the adjusting tools wherein the tools are permanently part of the yoke.

Dynamic adjustment is accomplished by a pair of adjusting tools 32 as depicted in FIGS. 5 and 6. Each tool 32 has a cylindrical body 34 with an offset pin 36 extending from the end. For ease of gripping and turning, the top end 38 can be angled as in FIG. 5 or knurled as in FIG. 11.

Figure 7:
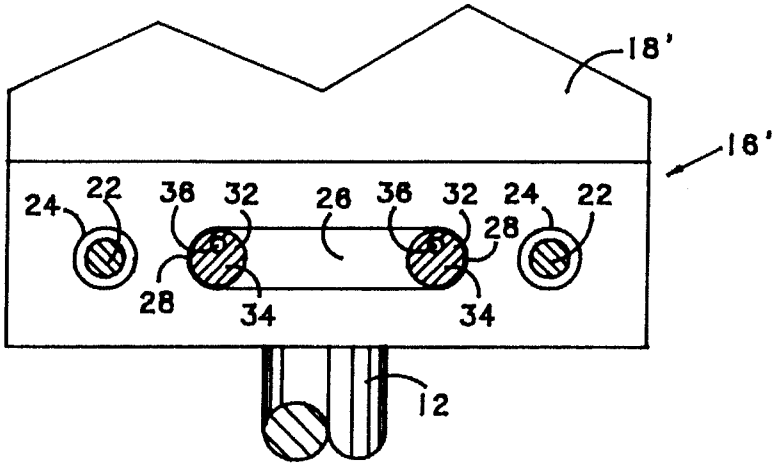
FIG. 7 is a plan view of the yoke of the present invention shown assembled with a pair of adjusting tools in place for adjusting and with the printhead in its furthest rearward position and laterally aligned.

To adjust the printhead 10 (carried by the shaft 12) with the yoke assembly 16' assembled as in FIG. 7, the pins 36 of the tools 32 are inserted in the bores 30 and the bodies 34 rotated until they fit into their respective slot ends 28. The machine screws 22 are then loosened just enough to allow the bottom piece 14' to move with respect to the top piece 18'. This lo prevents the possibility of the printhead 10 coming into too close of contact with the printing media. It also maintains the same spacing of the printhead 10 that is employed during printing so that the only factor being changed by the adjusting process is the printhead fore and aft position and skew.

With the printer in operation and printing, the tools 32 are then rotated about their respective pins 36 to force the bottom piece 14' in desired directions.

Figure 8:
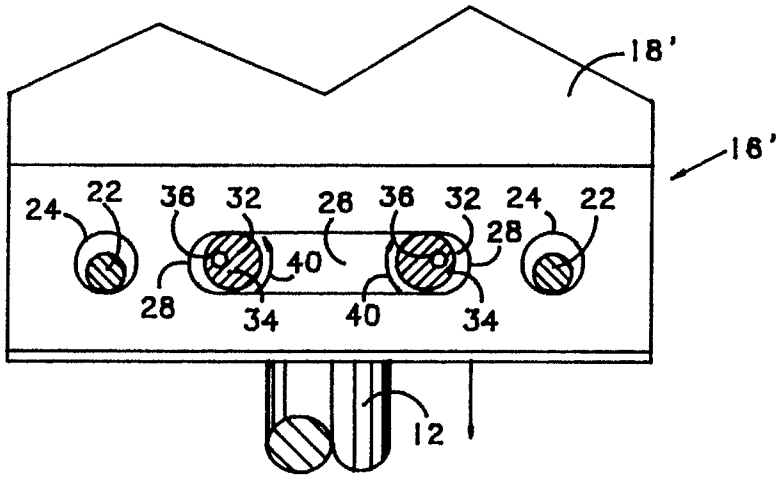
FIG. 8 is a plan view of the yoke of the present invention shown assembled with a pair of adjusting tools in place for adjusting and with the printhead being moved forward from its furthest rearward position and still laterally aligned.
Figure 9:
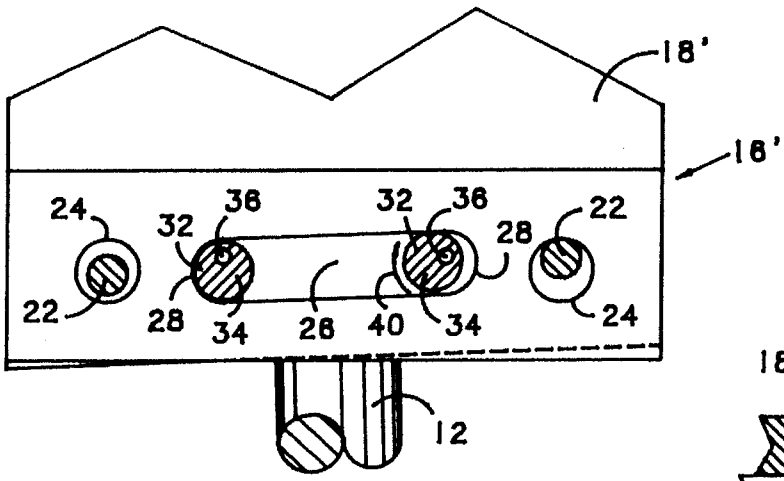
FIG. 9 is a plan view of the yoke of the present invention shown assembled with a pair of adjusting tools in place for adjusting and with the printhead being adjusted for skew.

For example, as depicted in FIG. 8, by rotating o the tools 32 in the direction of the arrows 40 in combination, the shaft 12 (and thereby the printhead 10) is moved forward without changing is skew. By rotating only one tool 32 as depicted in FIG. 9, the skew is adjusted. By rotating both tools 32 in different directions and/or different amounts, the fore and aft as well as the skew of the printhead 10 can be dynamically adjusted as the adjuster watches the print quality being produced. Using this process, the fore and aft positioning and the skew are simultaneously adjusted until the overall print quality is optimized. At that point, the machine screws 22 are tightened once again. In this manner, the adjuster can dynamically adjust the printhead for its maximum print quality. The job is done quickly and once with optimum results. And, it is as easily done in the field by a repair person as by a factory technician.

Figure 10:
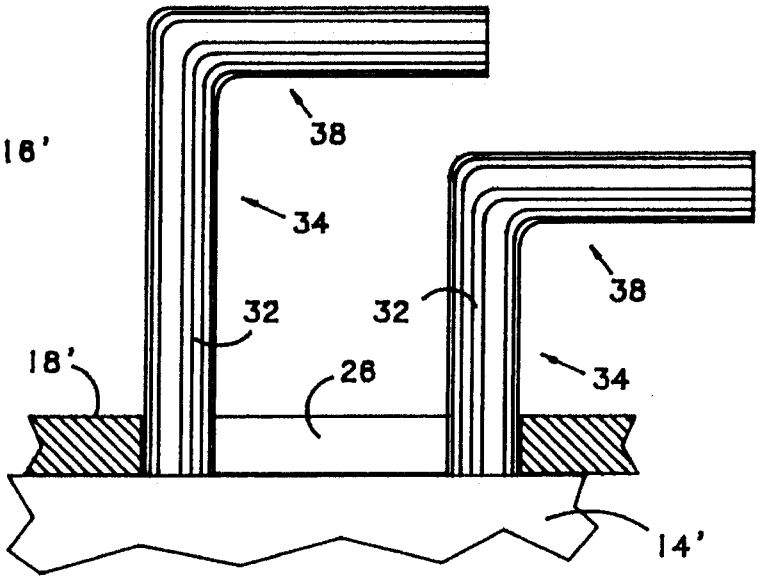
FIG. 10 is a partially cutaway view of the adjusting slot of the yoke of the present invention with a first embodiment of the adjusting tools wherein the tools are inserted for adjusting and then removed.

While it is preferred to have the tools 32 removable as depicted in FIG. 10 to prevent user self-adjusting, which would be contrary to warranty provisions, some manufacturers may wish to have the tools 32 remain part of the printer assembly for various reasons. In that case, an approach such as that of Figure 11 can be employed. The bodies of the tools 32 have an o added retaining ring 42 which is received by a mating groove 44 about the bottom of the slot ends 28. The groove 44 is sized to allow the tools 32 to rotate freely for adjusting purposes but prevents their being removed from the slot 26. In such an embodiment, it may be preferable to use knurled top ends 38 and shortened bodies 34 for space considerations.

Wherefore, having thus described the present invention, what is claimed is:

1. In a printhead-carrying adjustable yoke for a printer having a fixed portion and a movable portion carrying the printhead, apparatus for dynamically adjusting the printhead's position comprising:

a) fore and aft adjusting means for adjusting the printhead's fore and aft position while the printhead is printing; and, b) skew adjusting means for adjusting the printhead's skew while the printhead is printing.

2. The printhead position adjusting apparatus of claim 1 wherein said fore and aft adjusting means and said skew adjusting means comprise:

a) first adjusting means for moving a first side of the movable portion of the yoke forward and backward; and, b) second adjusting means for moving a second side of the movable portion of the yoke opposite said first side forward and backward.

3. The printhead position adjusting apparatus of claim 2 wherein:

a) said first adjusting means comprises a first eccentric carried by the movable portion of the yoke and pressing against surfaces of the fixed portion of the yoke to impart moving forces thereto; and, b) said second adjusting means comprises a second eccentric carried by the movable portion of the yoke and pressing against surfaces of the fixed portion of the yoke to impart moving forces thereto.

4. The printhead position adjusting apparatus of claim 3 wherein:

a) said first adjusting means comprises a first tool having a cylindrical body with a radially offset pin extending longitudinally from an end thereof; and, b) said second adjusting means comprises a second tool having a cylindrical body with a radially offset pin extending longitudinally from an end thereof.

5. The printhead position adjusting apparatus of claim 4 wherein additionally:

a) the movable portion of the yoke has a first pin-receiving bore and a second pin-receiving bore therein;

b) the fixed portion of the yoke has a slot therethrough with semi-cylindrical ends;

c) said cylindrical body of said first tool is positioned in a semi-cylindrical end with said pin thereof disposed in said first pin-receiving bore; and, d) said cylindrical body of said second tool is positioned in a semi-cylindrical end with said pin thereof disposed in said second pin-receiving bore.

6. The printhead position adjusting apparatus of claim 4 wherein:

said first tool and said second tool are removably carried by the yoke.

7. The printhead position adjusting apparatus of claim 4 wherein:

said first tool and said second tool have angled outer ends for gripping and turning.

8. The printhead position adjusting apparatus of claim 4 wherein:

said first tool and said second tool are non-removably carried by the yoke.

9. The printhead position adjusting apparatus of claim 4 wherein:

said first tool and said second tool have knurled outer ends for gripping and turning.

10. An adjustable printhead-carrying yoke for a printer which permits dynamic adjusting of the printhead's fore and aft and skew positions comprising:

a) a fixed yoke portion carried by the printer;

b) a movable yoke portion carrying the printhead;

c) fore and aft adjusting means for moving said movable yoke portion thereby adjusting the printhead's fore and aft position while the printhead is printing; and, d) skew adjusting means for moving said movable yoke portion thereby adjusting the printhead's skew while the printhead is printing.

11. The adjustable printhead-carrying yoke of claim 10 wherein said fore and aft adjusting means and said skew adjusting means comprise:

a) first adjusting means for moving a first side of said movable yoke portion forward and backward; and, b) second adjusting means for moving a second side of said movable yoke portion opposite said first side forward and backward.

12. The adjustable printhead-carrying yoke of claim 11 wherein:

a) said first adjusting means comprises a first eccentric carried by said movable yoke portion and pressing against surfaces of the fixed portion to impart moving forces thereto; and, b) said second adjusting means comprises a second eccentric carried by said movable yoke portion and pressing against surfaces of the fixed portion to impart moving forces thereto.

13. The adjustable printhead-carrying yoke of claim 12 wherein:

a) said first adjusting means comprises a first tool having a cylindrical body with a radially offset pin extending longitudinally from an end thereof; and, b) said second adjusting means comprises a second tool having a cylindrical body with a radially offset pin extending longitudinally from an end thereof.

14. The adjustable printhead-carrying yoke of claim 13 wherein additionally:

a) said movable yoke portion has a first pin-receiving bore and a second pin-receiving bore therein;

b) the fixed portion has a slot therethrough with semi-cylindrical ends;

c) said cylindrical body of said first tool is positioned in a semi-cylindrical end with said pin thereof disposed in said first pin-receiving bore; and, d) said cylindrical body of said second tool is positioned in a semi-cylindrical end with said pin thereof disposed in said second pin-receiving bore.

15. The adjustable printhead-carrying yoke of claim 13 wherein:

said first tool and said second tool are removably carried by the yoke.

16. The adjustable printhead-carrying yoke of claim 13 wherein:

said first tool and said second tool have angled outer ends for gripping and turning.

17. The adjustable printhead-carrying yoke of claim 13 wherein:

said first tool and said second tool are non-removably carried by the yoke.

18. The adjustable printhead-carrying yoke of claim 13 wherein:

said first tool and said second tool have knurled outer ends for gripping and turning.

19. In a printhead-carrying adjustable yoke for a printer having a fixed portion and a movable portion carrying the printhead wherein the movable portion is connected to the fixed portion by gripping members passing through clearance bores, a method of dynamically adjusting fore and aft and skew positions of the printhead comprising the steps of:

a) loosening the gripping members sufficiently to allow the movable portion to be moved relative to the fixed portion without changing spacing of the printhead from a printing media disposed thereunder;

b) printing on the media with the printhead and while printing, b1) applying equal fore and aft urging forces to the movable portion on opposite ends thereof to change the fore and aft position of the printhead, b2) visually inspecting print quality on the media and terminating step (b1) when an optimum print quality is achieved, b3) applying unequal fore and aft urging forces to the movable portion on opposite ends thereof to change the skew of the printhead, b4) visually inspecting print quality on the media and terminating step (b3) when an optimum print quality is achieved, and b5) repeating steps (b1) through (b4) as necessary until overall optimum print quality is achieved; and, c) tightening the gripping members to prevent further movement of the movable portion relative to the fixed portion once overall optimum print quality is achieved.

* * * * *